US012392073B2

(12) United States Patent
Barve et al.

(10) Patent No.: US 12,392,073 B2
(45) Date of Patent: Aug. 19, 2025

(54) LAUNDRY TREATING APPLIANCE

(71) Applicant: WHIRLPOOL CORPORATION, Benton Harbor, MI (US)

(72) Inventors: Adish Anil Barve, Pune (IN); Martin Prostejovsky, Poprad (SK); Roman Rakoci, Poprad (SK)

(73) Assignee: Whirlpool Corporation, Benton Harbor, MI (US)

( * ) Notice: Subject to any disclaimer, the term of this patent is extended or adjusted under 35 U.S.C. 154(b) by 201 days.

(21) Appl. No.: 18/137,139

(22) Filed: Apr. 20, 2023

(65) Prior Publication Data

US 2024/0352640 A1 Oct. 24, 2024

(51) Int. Cl.
*D06F 34/30* (2020.01)
*D06F 34/34* (2020.01)

(52) U.S. Cl.
CPC ..... *D06F 34/30* (2020.02); *D06F 34/34* (2020.02)

(58) Field of Classification Search
CPC ..... D06F 34/30
See application file for complete search history.

(56) References Cited

U.S. PATENT DOCUMENTS

| | | | | |
|---|---|---|---|---|
| 2,742,015 | A * | 4/1956 | Hoyle | D06F 34/30 362/89 |
| 9,589,748 | B2 | 3/2017 | Heater et al. | |
| 11,291,131 | B2 | 3/2022 | Cui et al. | |
| 11,302,496 | B2 | 4/2022 | Anderson et al. | |
| 2006/0164397 | A1* | 7/2006 | Bruntz | D06F 34/30 345/172 |
| 2008/0289940 | A1* | 11/2008 | Kim | H01H 19/02 200/336 |
| 2010/0043499 | A1* | 2/2010 | Choi | D06F 34/30 68/13 R |
| 2021/0005403 | A1* | 1/2021 | Huang | H01H 9/181 |
| 2022/0120009 | A1* | 4/2022 | Huang | H05K 1/181 |
| 2022/0181103 | A1 | 6/2022 | Anderson et al. | |

FOREIGN PATENT DOCUMENTS

| | | | | |
|---|---|---|---|---|
| CN | 208538731 | U | 2/2019 | |
| CN | 209658049 | U | 11/2019 | |
| CN | 210052659 | U | 2/2020 | |
| CN | 213958834 | U | 8/2021 | |
| EP | 2937455 | A1 * | 10/2015 | D06F 34/28 |

OTHER PUBLICATIONS

Mastertec; Puddle Flange for Waterproofing of Pipes in Concrete Construction; Available at https://www.mastertec.eu/en/products/pressure-water-tight-service-ducts/puddle-flange; Accessed Jun. 28, 2022; 7 pages.

* cited by examiner

*Primary Examiner* — Spencer E. Bell
(74) *Attorney, Agent, or Firm* — McGarry Bair PC

(57) ABSTRACT

A laundry treating appliance includes a cabinet defining a cabinet interior, a drum, rotatable within the cabinet interior, at least partially defines a treating chamber for holding laundry items for treatment. A lid provides access to the cabinet interior. A user interface is carried by the cabinet and includes a console having a first input opening, a controller including a printed circuit board (PCB) located behind the console, and a rotary knob assembly and push button assembly located above the console and operably coupled to the PCB. A liquid seal is formed between the console and the rotary knob assembly and the console and the push button.

14 Claims, 7 Drawing Sheets

LAUNDRY TREATING APPLIANCE

BACKGROUND

Laundry treating appliances, such as washing machines, combination washer/dryers, condensing dryers, refreshers, and non-aqueous systems, can have a configuration based on a rotating laundry basket or drum that defines a drum opening and at least partially defines a treating chamber in which laundry items are placed for treating. The drum can be provided within an interior of a tub that defines a tub opening and further can at least partially define the treating chamber. The laundry treating appliance can have a controller that implements a number of user-selectable, pre-programmed cycles of operation having one or more operating parameters. Hot water, cold water, or a mixture thereof, along with various treating chemistries, can be supplied to the treating chamber in accordance with the cycle of operation.

BRIEF SUMMARY

A laundry treating appliance includes a cabinet defining a cabinet interior, a drum, rotatable within the cabinet interior, at least partially defines a treating chamber for holding laundry items for treatment. A lid provides access to the cabinet interior. A user interface is carried by the cabinet and includes a console having a first input opening, a controller including a printed circuit board (PCB) located behind the console, and a rotary knob and push button assembly located above the console and operably coupled to the PCB. A liquid seal is formed between the console and the rotary knob and the console and the push button.

DETAILED DESCRIPTION

The description is directed to solving the problem of a liquid spill on the user interface of a home appliance console, such as a laundry treating appliance. Such liquid spills can be in the form of treating chemistries or water and can involve larger volumes of liquid, which might overflow or flood prior liquid spill solutions. The spilled liquid is prevented from reaching the electronic components in the user interface. The spilled liquid can be directed around or away from the electronic components and/or contained. The solution is specifically useful for user interfaces that are located on an upper, outer surface of a home appliance, such as a console located along a rear portion of the upper surface of the appliance cabinet. Such consoles typically have a more gently sloped face, as compared to a console on a vertical front surface of the appliance, which lets the spilled liquid dwell on the surface for a slightly longer time. While the solution is described in the environment of a laundry treating appliance, it has applicability to other household appliances.

Figure 1:
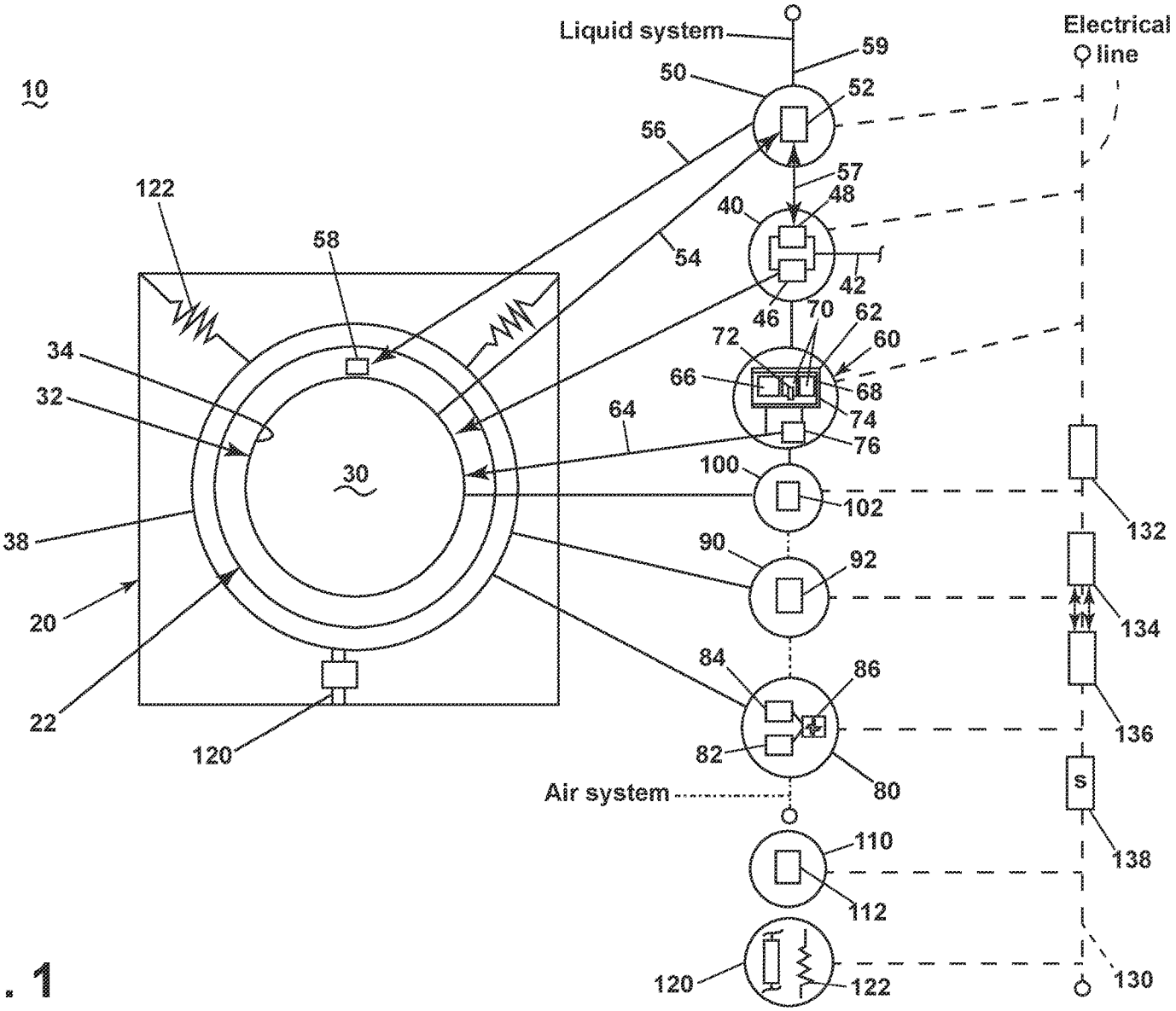
FIG. 1 illustrates a schematic view of a laundry treating appliance.

FIG. 1 schematically illustrates a laundry treating appliance 10 including a cabinet 20 in which a treating chamber 30 is located, along with a plurality of systems, with one or more of the systems controlled by a controller 130 to carry out a treating cycle of operation on laundry within the treating chamber 30. Examples of such laundry treating appliances 10 include, without limitation, clothes washer (washer), clothes dryer (dryer), combination washer/dryer (combo), and/or refreshers. Different combinations of the systems can be used depending on the type of laundry treating appliance 10.

The cabinet 20 can include a closure 22 that selectively provides access to the treating chamber 30 through a cabinet access opening. The closure 22 can vary depending on the type and configuration of the laundry treating appliance 10. For front-loading laundry treating appliances, the closure can be a door moveably mounted relative to a front of the cabinet 20. For top-loading appliances, the closure can be a lid moveably mounted to a top of the cabinet 20. In a drawer-type appliance, the closure is the cabinet that a drawer slides in and out of. In some configurations, the closure can extend over at least a portion of both the top and front of the cabinet 20. The cabinet 20 can be implemented by a chassis or frame to which a variety of panels (front, back, left, right, and top) are mounted, with the panels forming the cabinet exterior.

The treating chamber 30 can be a container 32 defining an access opening 34, which is selectively closed by the closure 22. The container 32 can be oriented in the cabinet 20 such that the access opening 34 faces one or more sides of the cabinet 20. For front-loading appliances, the access opening 34 generally faces a front of the cabinet 20 and for top-loading appliances, the access opening 34 generally faces a top of the cabinet 20. The container 32 can be stationary or it can move, such as by translating, rotating, or reciprocating, for example.

The container 32 can be configured to hold liquid, such as in a dryer-only configuration or a low-pressure dryer. The container 32 can also be configured to let liquid pass through, such as by having a series of perforations, such as in a clothes washer or a combo washer/dryer. In a liquid pass through configuration, the container 32 can be located partially or completely within a liquid holding tub 38, which catches the liquid after passing through the container 32. In a vertical axis clothes washer, the container is often referred to as a basket, and in a horizontal axis clothes washer, the container is often referred to as a drum.

The container 32, alone, or in combination with the tub 38, can be sealed, including the closure 22, relative to atmosphere to provide a low-pressure chamber, i.e. lower than ambient pressure, suitable for a low-pressure drying cycle, where the pressure inside the treating chamber 30 is dropped, relative to the ambient pressure, a sufficient amount to effect a flash drying of the liquid. Such a sealing need not be a perfect seal as the low pressure need not be a vacuum to effect a flash drying.

The different systems can include a water system 40, which receives water from a household water supply line 42 and supplies the water to other systems and/or the treating chamber 30 along water supply lines 44. The water system 40 can optionally include a water treater 46 and a water tank 48. The water treater 46 can treat the water from the household water supply line 42 and then supply the treated water to the tank 48, the systems, or the treating chamber 30. The water treater 46 can be a water softener, an ionizer, etc. The tank 48 can be cither or both a supply tank or a reuse tank. As a supply tank, the tank 48 stores water from the household water supply and supplies it as demanded. For convenience, the tank 48 can be sized such that it holds a predetermined volume of water that corresponds to a volume contemplated for use in the laundry treating appliance 10, which can be referred to as a "charge" of water. As a reuse tank, the tank 48 stores water that is used in a treating cycle of operation, which means the stored water may, but not necessarily, include chemicals, such as detergents, softeners, etc., and can be described as a wash liquid. The tank 48 can be located near or in abutting contact with the treating chamber 30 such that heat from the treating chamber 30 is transferred to the tank 48 and any contents within the tank 48.

A recirculation system 50 can recirculate liquid from the treating chamber 30 back to the treating chamber 30. To accomplish the recirculation, the recirculation system 50 can include at least one pump 52, which draws liquid from the treating chamber 30, through a return line 54, such as from the container 32 or tub 38, and returns it, through a re-supply line 56, to the treating chamber 30, such as through a nozzle 58. The nozzle 58 can be in the form of a plain tube and/or a spray head, which may have a predetermined spray pattern. The return line 54 and re-supply line 56 can be thought of as a liquid recirculation circuit for the treating chamber 30. The return line 54 can originate from a sump fluidly connected to or formed as part of the tub 38.

Additional liquid lines can be provided to redirect the liquid as desired outside of the recirculation system 50. For example, a reuse line 57 can fluidly couple the output of the pump 52 to the tank 48, where the liquid may be stored for reuse in the current cycle of operation or for a future cycle of operation. A drain line 59 can be coupled to the pump 52 such that the output of the pump 52 is supplied to a household drain. In some configurations, the pump 52 can include multiple pumps, such as a drain pump and a recirculation pump, with the drain pump typically being more robust to handle foreign objects and other items that are not recirculated, but are removed down the drain.

A dispensing system 60 dispenses treating chemistry, directly or indirectly, into the treating chamber 30. The dispensing system includes a dispenser 62 that is connected to the treating chamber 30 by a conduit 64, such that chemistry dispensed from the dispenser 62 travels through the conduit 64 to the treating chamber 30. The dispenser 62 can have one or more sources 66 of treating chemistry, which can be either or both single-use or bulk sources of treating chemistry. Single-use sources will typically contain a single "charge" of treating chemistry that is fully dispensed over a cycle of operation, whereas bulk sources contain multiple charges of treating chemistry. In a single-use configuration, the source 66 can be a cup or other container that is manually filled or a cartridge that is replaced by the user. In a bulk-use configuration, the source 66 can be a container that is re-filled by the user or a container that is replaced after multiple cycles. Typically, the types of chemistries that might be dispensed include: detergent, fabric softener, bleach, and enzymes.

One configuration for the dispenser 62 is a drawer 68 within which are located one or more cups 70 having a fluid outlet, like a siphon 72. A housing 74 underlies the siphon 72 and is fluidly coupled to the treating chamber 30 by the conduit 64. The water system 40 and/or the recirculation system 50 supplies water to the cup 70, which floods the cup 70, causing the chemistry in the cup 70 to mix with the water and flow out the siphon 72. Alternatively, a pump 76 can fluidly couple the cup 70 directly to the conduit 64 and/or the treating chamber 30.

An air system 80 supplies air to the treating chamber 30. The supply of air can be one or both of a pass-through air supply circuit 82 or a recirculating air supply circuit 84. The air system 80 can include an air flower 86, such as a fan or blower, to flow air through the pass-through air supply circuit 82 or the recirculating air supply circuit 84.

A heating system 90 can be used to heat fluid, liquid, or air, used in the treating chamber 30. The heating system 90 can include one or more heaters 92, including a resistive heater, immersible or non-immersible, a heat pump, or a gas heater, for example. The heater 92 can be located in the tub 38, such as an immersion heater in a sump formed by the tub 38, or located in one of the pass-through or recirculating air supply circuits 82, 84. In some implementations, both an immersible heater can be used in the sump and a resistive or gas heater used inline in one or both of the air supply circuits 82, 84.

A moisture removing system 100 removes moisture from the treating chamber 30 and/or laundry located within the treating chamber 30. The moisture removing system 100 can combine the air system 80 and the heating system 90 to supply heated air to the treating chamber 30. The moisture removing system 100 can just supply heat to the treating chamber 30, without the supplying of air, and rely on natural convection air flow for moisture removal. The moisture removing system 100 can also just supply air, without the addition of heat, to the treating chamber 30. An optional condenser 102 can be provided to receive the naturally flowing air or the forced air from the air system 80 and condense moisture from the air passing through the condenser 102. The condenser 102 can be fluidly coupled to at least one of the water system 40 or the recirculation system 50 such that the condensate can be stored for reuse in the tank 48 or drained.

A movement system 110 is provided for imparting motion or mechanical energy to laundry within the treating chamber 30 or to the treating chamber 30. The motion can be rotational or linear in one or more axes. For example, in horizontal axis appliances, the container 32 can be rotated about a rotational axis to effect a lifting/dropping or tumbling of the laundry and thereby impart mechanical energy to the laundry, and, or in addition, the container 32 can be reciprocated in one or more of the three primary axes to also impart mechanical energy to the laundry. In vertical axis appliances, a clothes mover can reside within the treating chamber and impart mechanical energy to the laundry. The clothes mover can be one or more, alone or in combination, of an agitator, auger, impeller, wash plate, nutator, pulsator, just to name a few. These clothes movers can rotate, either clockwise (CW) or counterclockwise (CCW), or reciprocally rotate between the CW and CCW directions. The agitators can also reciprocate about an axis, which can be a rotational axis, where the clothes mover both rotates and reciprocates, or at least has one portion that rotates and another portion the reciprocates, as in a combination agitator with a pulsator.

The movement system 110 can be implemented with an electric motor 112 that is directly or indirectly coupled to the container 32 or clothes mover to drive the movement of the container 32 or clothes mover. In some implementations, the electric motor 112 can be directly mounted to the tub 38 and connected to the container 32 or clothes mover via a drive shaft.

For purposes of this description, the terms horizontal axis and vertical axis are used to represent the general orientation of the axis of rotation and is not meant to be limited to a perfectly horizontal or perfectly vertical axis of rotation. The terms horizontal axis of rotation or vertical axis of rotation, when used to identify the type of laundry treating appliance, are more accurately used to describe the primary mechanism by which mechanical energy is imparted to the laundry. The horizontal axis washing machine imparts mechanical energy primarily by tumbling the laundry within the drum (container). That is, rotation of the drum lifts and then drops the laundry. This lifting/dropping imparts mechanical energy to the laundry. The vertical axis washing machine imparts mechanical energy via a clothes mover located in the basket (container), such as an agitator, impeller, pulsator, auger, etc., which is rotated within the basket to effect movement of liquid in the basket or directly impact the laundry. While a laundry container is normally referred to as a drum for a horizontal axis machine and a basket for a vertical axis machine, for this disclosure, unless otherwise stated, drum and basket are interchangeable. Additionally, while most horizontal axis clothes washers are front loading and most vertical axis clothes washers are top loading, that need not be the case. Horizontal axis clothes washers can be top loaders, and typically have a door in the side of the drum. Vertical axis clothes washers can have a lid that extends into the front of the cabinet.

A suspension system 120 can be used to support one or more of the components of the movement system 110 or other system components, which are moved by the movement system 110. For example, one or more suspension components can support the tub 38 and/or container 32 relative to the cabinet 20. The suspension components can include one or more springs 122 and/or dampeners 124 coupling the tub 38 or container 32 to the cabinet 20. The spring 122/dampener 124 can be combined into a single device like a shock absorber. One implementation is for springs 122 to suspend an upper portion of the tub 38 from the cabinet 20 or a frame within the cabinet 20 in combination with a dampener 124 coupling a lower portion of the tub 38 to a floor of the cabinet 20.

A controller 130 is operably coupled to the various systems and their components to control the operation of the laundry treating appliance 10 and its various working systems to control the operation of the working systems and to implement one or more treating cycles of operation. A user interface 132 is operably coupled with the controller 130. The user interface 132 can provide an input and output function for the controller 130. The user interface 132 can be provided or integrated with the closure 22 or can be provided on the cabinet 20.

The user interface 132 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 130 to communicate with the user in a variety of ways. For example, the controller 130 can be configured to send a text message to the user, send an electronic mail to the user, or provide audio information to the user either through the laundry treating appliance 10 or utilizing another device such as a mobile phone.

The controller 130 can include the machine controller and any additional controllers provided for controlling any of the systems of the laundry treating appliance 10. For example, the controller 130 can include the machine controller and a motor controller. Many known types of controllers can be used for the controller 130. It is contemplated that the controller is a microprocessor-based controller that implements control software and sends/receives one or more electrical signals to/from each of the various working systems to effect the control software. As an example, proportional control (P), proportional integral control (PI), and proportional derivative control (PD), or a combination thereof, a proportional integral derivative control (PID control), can be used to control the various systems.

The controller 130 can be provided with a memory 134 and a central processing unit (CPU) 136. The memory 134 can be used for storing the control software that is executed by the CPU 136 in completing a cycle of operation using the laundry treating appliance 10 and any additional software. For example, the memory 134 can store a set of executable instructions including at least one user-selectable cycle of operation. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 132. The memory 134 can also be used to store information, such as a database or table, and to store data received from one or more systems of the laundry treating appliance 10 that can be communicably coupled with the controller 130. The database or table can be used to store the various operating parameters for the one or more cycles of operation, including factory default values for the operating parameters and any adjustments to them by the control assembly or by user input.

The controller 130 can be operably coupled with one or more systems of the laundry treating appliance 10 for communicating with and controlling the operation of the systems to complete a cycle of operation. For example, the controller 130 can be operably coupled with the water system 40 for controlling the temperature and flow rate of treating liquid into the treating chamber 30, the motor 112 for controlling the direction and speed of rotation of the container 32, the pump 52 for controlling the amount of treating liquid in the treating chamber 30 or sump, the dispenser 62 for controlling the flow of treating chemistries into the treating chamber 30, the user interface 132 for receiving user selected inputs and communicating information to the user, and the heater 92, the moisture removing system 100, including the air flower 86 and the heating system 90, to control the operation of these and other systems to implement one or more of the cycles of operation.

The controller 130 can also be coupled with one or more sensors 138 provided in one or more of the assemblies of the laundry treating appliance 10 to receive input from the sensors 138, which are known in the art and not shown for simplicity. Non-limiting examples of sensors 138 that can be communicably coupled with the controller 130 include: a treating chamber temperature sensor, such as a thermistor, which can detect the temperature of the treating liquid in the treating chamber 30 and/or the temperature of the treating liquid being supplied to the treating chamber 30, a moisture sensor, a weight sensor, a chemical sensor, a position sensor, an imbalance sensor, a load size sensor, and a motor torque sensor, which can be used to determine a variety of assembly and laundry characteristics, such as laundry load inertia or mass.

Figure 2:
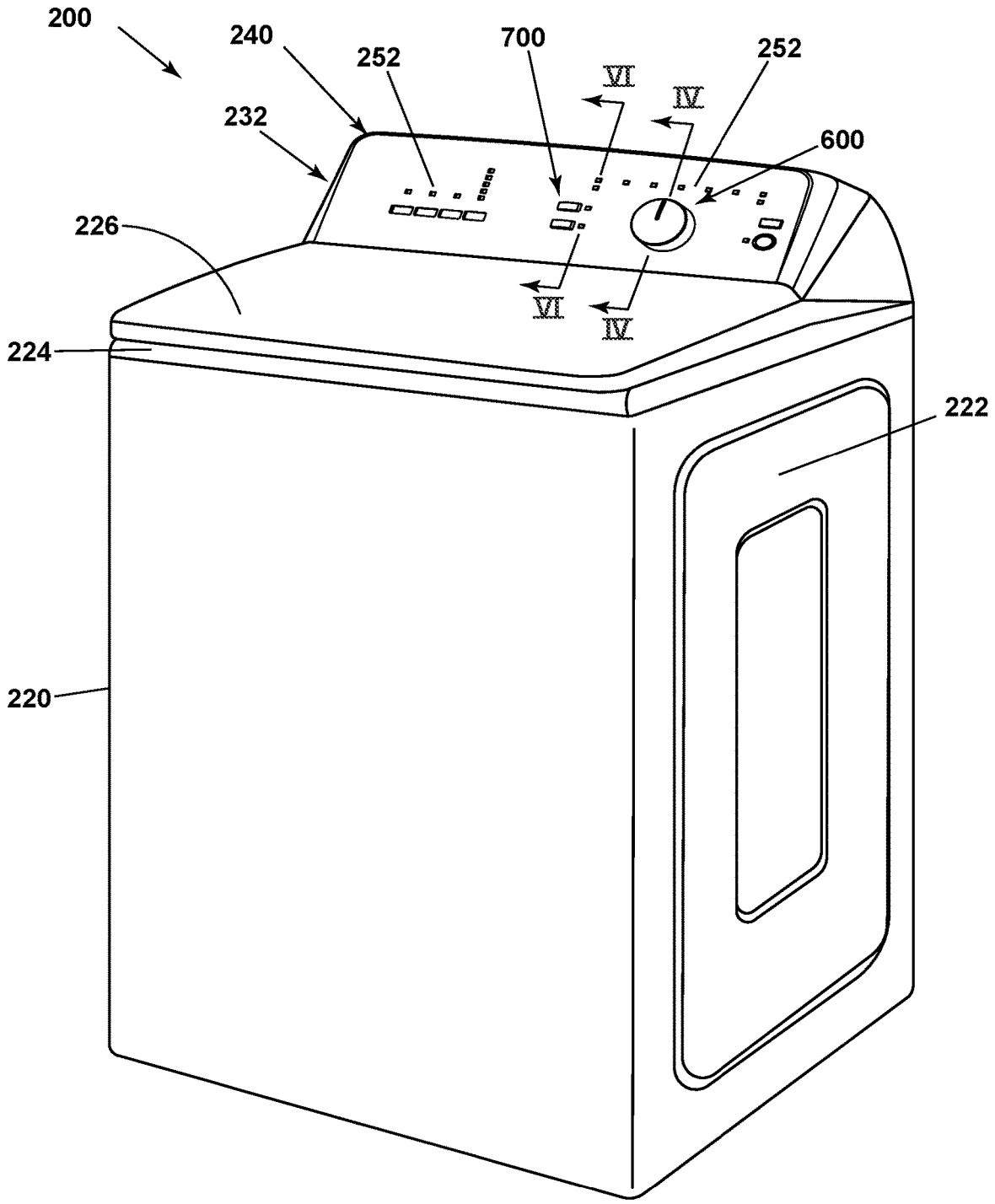
FIG. 2 is a schematic perspective view of a top-loading, laundry treating appliance illustrating a user interface.

Referring to FIG. 2, a top-loading clothes washer 200 is illustrated, which has many parts and features similar to the laundry treating appliance 10, and therefore like parts and features will be identified with like numerals increased by 200. The clothes washer 200 can include a cabinet 220 forming an interior 222. The interior 222 is covered by a horizontal top wall 224 in which a selectively openable lid 226 covers an access opening 234 for access to the interior 222. A user interface 232 is located along a rear of the top wall 224 and is oriented at an acute angle relative to the top wall 224 to provide a convenient viewing angle for the user.

Figure 3:
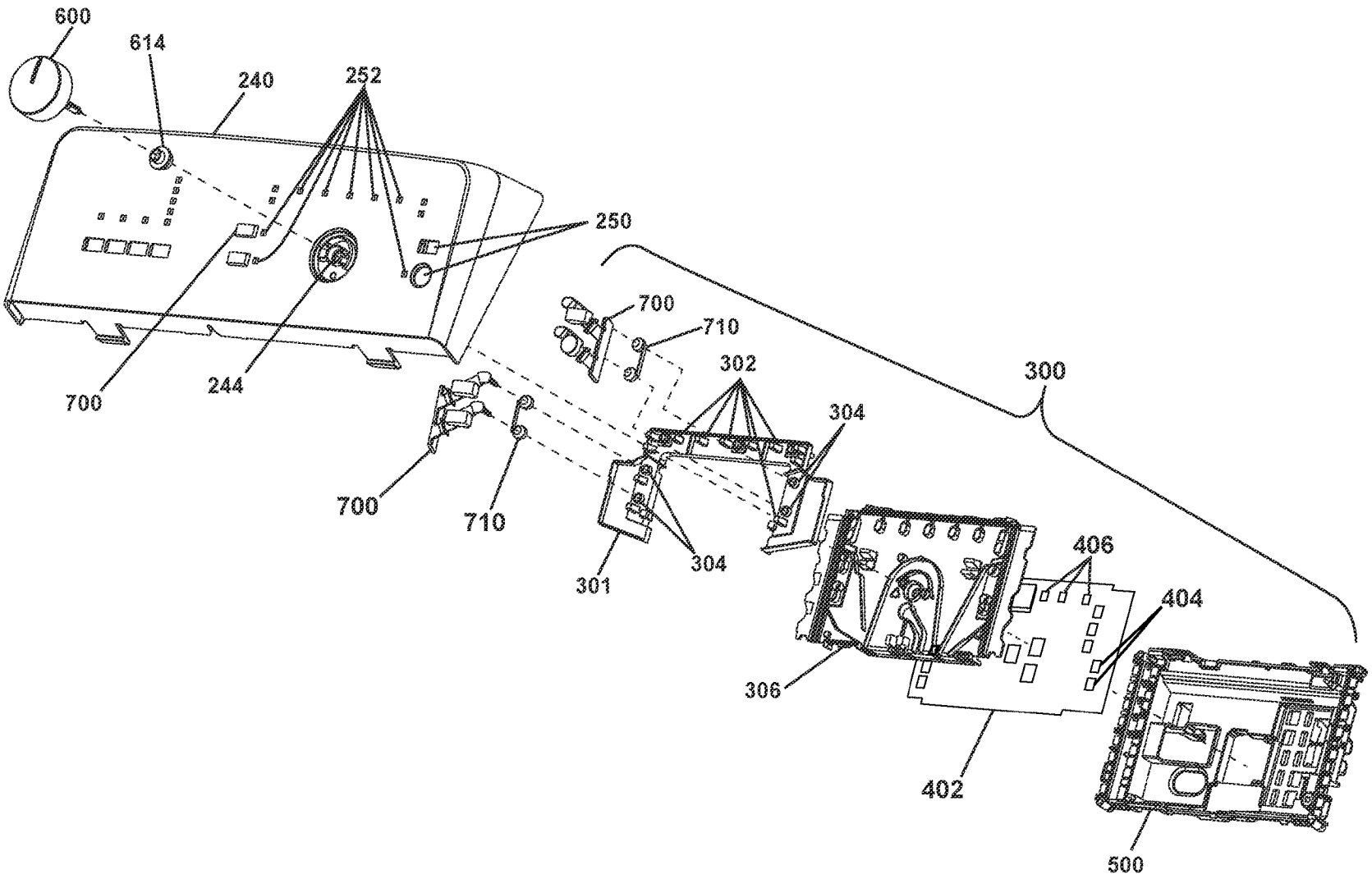
FIG. 3 is an exploded view of the user interface of FIG. 2 including a console, input devices (knob assembly and a push button assembly), light guide, and printed circuit board (PCB).

Referring to FIG. 3, the user interface 232 includes a console 240 overlying a light guide assembly 300, which overlies a printed circuit board (PCB) 402, which is supported by a back panel 500. User input devices, illustrated as, but not limited to, a knob assembly 600 and push button assembly 700, enable the user to input selections to the PCB 402. The PCB 402 includes various switches 404 and light emitting diodes (LED) 406, some of which correspond to the switches 404 to indicate the status of the switches 404. The light guide assembly 300 is separate from the push button assembly 700, however, it is contemplated they could be integrated.

The console 240 further includes a first input opening 244, through which the knob assembly 600 can couple to the PCB 402, a second input opening 250, through which the push button assembly 700 is accessible, and a plurality of third console light openings 252, through which light from the PCB 402 can be projected for viewing by the user. A catch 248 (FIG. 4) circumscribes the first input opening 244 and helps hold the knob assembly 600 to the console 240 and retards its withdrawal.

Light guide assembly 300 includes a first plate 301 and a second plate 306 which together transfers light emitted from the PCB 402 to the console 240. The first plate 301 includes a plurality of light pipes 302 and a plurality of push button guide collars 304. The light pipe 302 transmits light from a light source, which may be the LEDs 406, on the PCB 402 out through the console light openings 252. The push button guide collar 304 provides a hub through which a portion of the push button assembly 700 is slidably received.

The PCB 402 is mounted to the back panel 500. The PCB 402 further comprises a plurality of depressible switches 404, some of which may be depressible switches, and a series of LEDs 406, as well as other commonly known components such as a rotary knob input to an encoder, potentiometer or rheostat. The depressible switches 404 and the LEDs 406 are aligned with the corresponding first and second openings 250, 252 on the console 240 when the console 240 is assembled.

The back panel 500 is mounted over the PCB 402 and secures the PCB 402 to the console 240.

Figure 4:
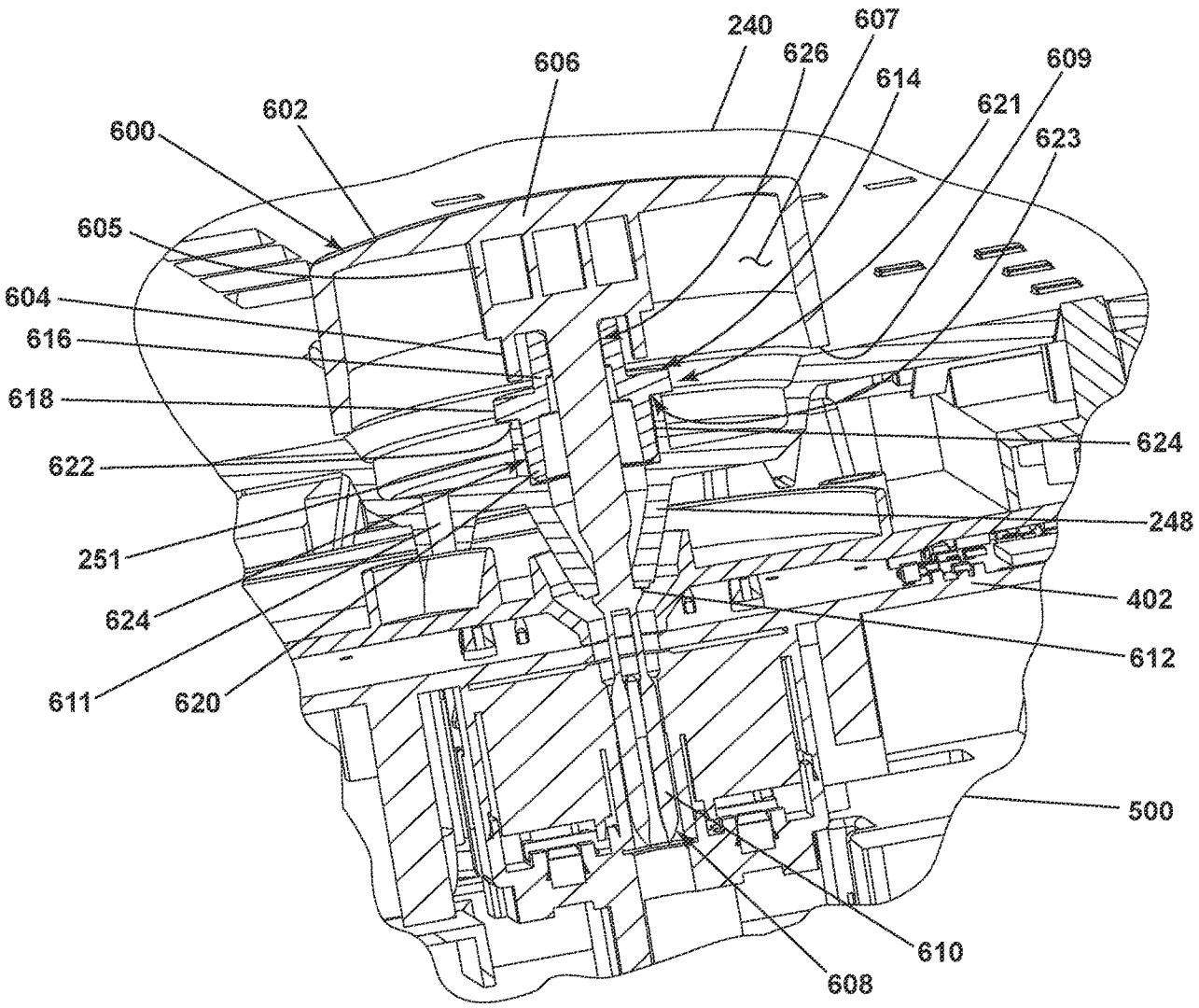
FIG. 4 is a perspective, cross-sectional view of an enlarged portion of the knob assembly taken along the line IV-IV of FIG. 3 illustrating a liquid seal with the knob, console and PCB.

Referring to FIG. 4, a rotary knob assembly 600 includes the knob 602 fixed to an input shaft 608 and covered with a dome 606 on one end of the input shaft 608. A first collar 604 circumscribes the input shaft 608 and extends from a hub 605 of the knob 602. The dome 606 terminates in an annular edge 609 spaced above the console 240 and forms a hollow interior 607. The input shaft 608 further comprises a pin 610 on which an annular detent 612 is formed in a ring-shaped fashion which is caught by the console catch 248 to retard removal of the rotary knob assembly 600 from the console 240. A liquid flow path is formed by a gap between the annular edge 609 and the console 240. Liquid flowing into the gap is received within a recess in the console 240 below the dome 606 and is drained via a drain hole 611. In the case of a liquid spill, where larger amounts of liquid flood the console 240 and cannot be timely drained through the drain hole 611, a liquid seal 621 prevents the flooding liquid from reaching the PCB 402.

The liquid seal 621 is formed between the knob assembly 600 and the console 240. The liquid seal 621 comprises a second collar 251 on the console 240 and a rimmed bushing 614. The second collar 251 circumscribes the first input opening 244 and terminates in an upper edge 622. The rimmed bushing 614 has an annular disk 618 from which extends a first ring 616 and a second ring 620. The annular disk 618 abuts the upper edge 622 to form a first seal interface 623 for the liquid seal 621. The second ring 620 sits within, and is adjacent to, the second collar 251 to form a second seal interface 624. The close fit between the second ring 620 and the second collar 251 forms the second seal interface 624. Collectively, if both the first seal interface 623 and second seal interface 624 are used, they form a labyrinth seal. A third seal interface 626 can be formed by the first ring 616 of the rimmed busing 614 sitting within the first collar 604.

The spatial relationship between the first collar 604, rimmed bushing 614, second collar 251, a detent 612 on the knob assembly 600, and catch 248, create a tolerance such that the annular disk 618 is biased against the upper edge 622 of the second collar 251, yet the knob 602 is still free to rotate. The spatial relation can be such that there is a slight compression of the annular disk 618 against the upper edge 622 of the second collar 251. The compressive force should not be so great that it prevents rotation of the knob.

Figure 5:
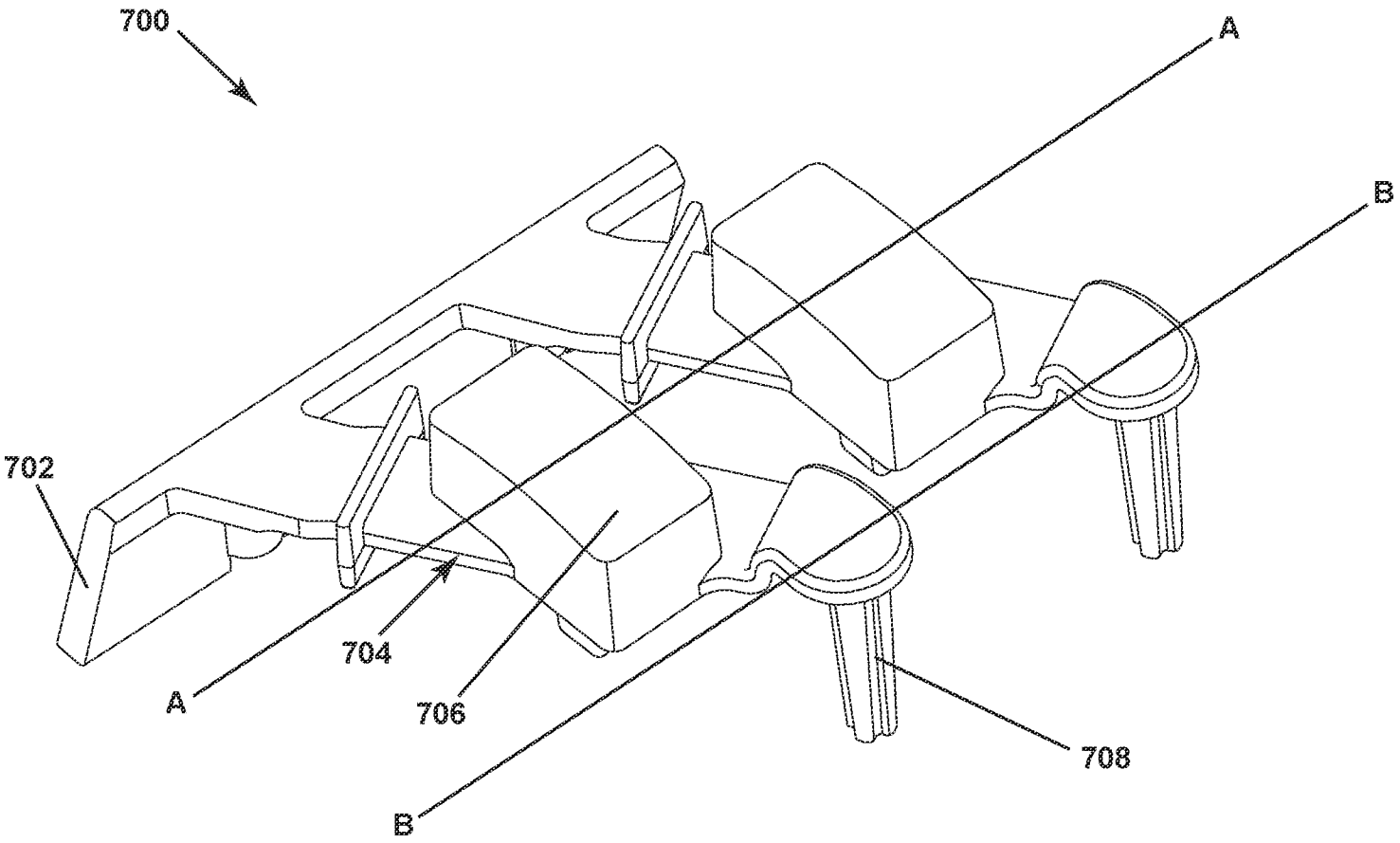
FIG. 5 is a perspective view of the push button assembly of FIG. 3.

Referring to FIG. 5, the push button assembly 700 includes a support structure 702 and a button arm 704. The button arm 704 is flexibly mounted to the support structure 702 so that the button arm 704 can deflect when under pressure. The button arm 704 further includes a user-engageable button 706. A button pin 708 extends orthogonally from the button arm 704 and is aligned with a corresponding depressible switch 404 located on the PCB 402. A centerline A-A drawn through the centers of the buttons 706 is offset from centerline B-B drawn through the centerline of the button pins 708 indicating that the buttons 706 are offset from the button pins 708.

Figure 6:
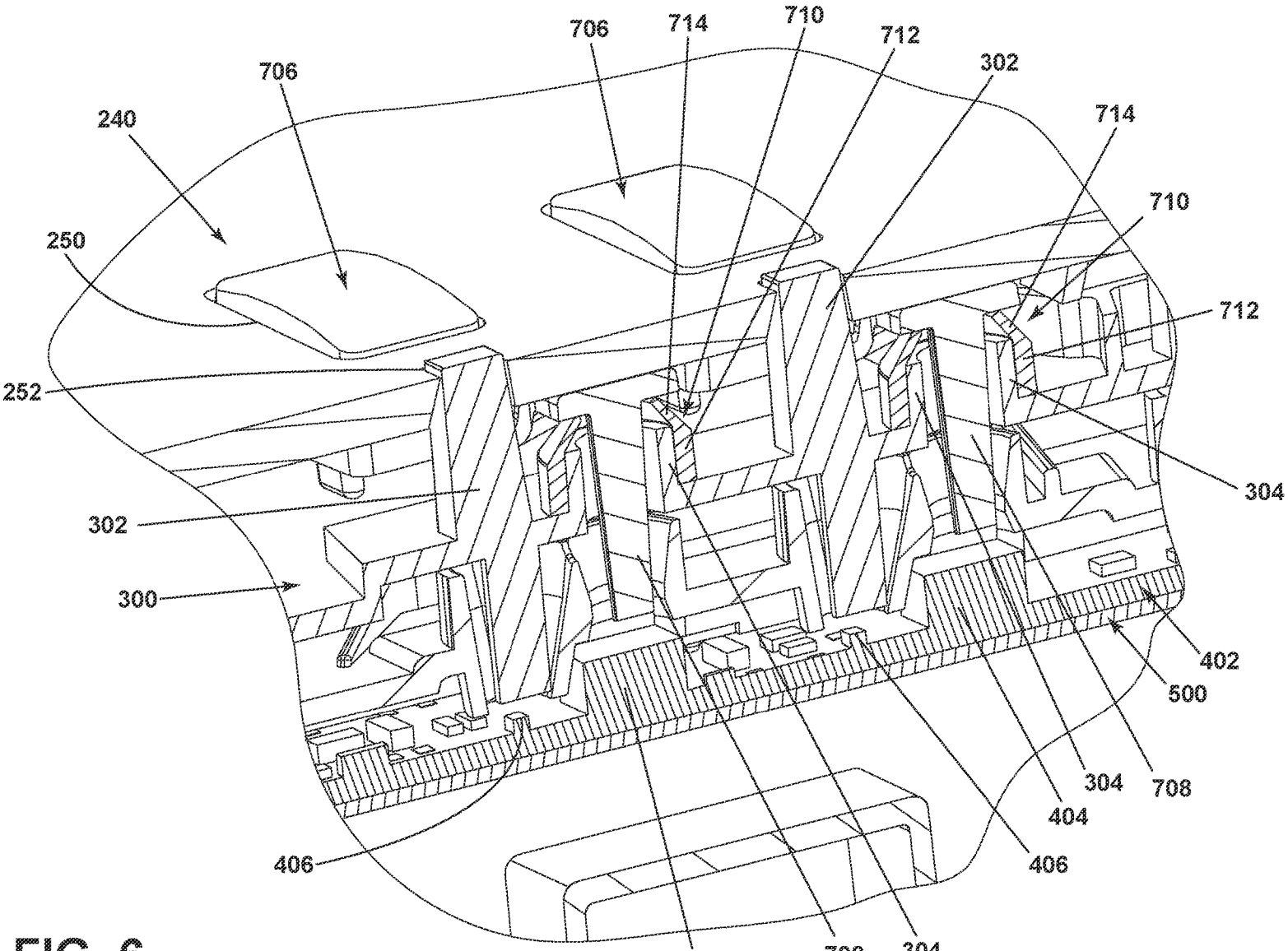
FIG. 6 is a perspective, cross-sectional view taken along the line VI-VI of FIG. 2 and illustrating the push button assembly of FIG. 3 including a liquid seal and with the push button in a non-pressed state.

Referring to FIG. 6 which illustrates a sectional view taken along line VI-VI of FIG. 2, when the user interface 232 is assembled, the button pins 708 extend through the push button collars 304 of the light guide assembly 300 and are aligned with the switches 404 on the PCB 402. The light pipes 302 are aligned with an LED 406 on the PCB 402. The light pipes 302 extend into the light openings 252 on the console 240.

A deflectable seal 710 further comprises a hollow annular body 712 terminating in a deflectable flange 714. The annular body 712 circumscribes the push button guide collar 304 on the light guide assembly 300. The deflectable flange 714 overlies an upper end of the push button guide collar 304 and directly contacts the push button pin 708. The deflectable flange 714, in cross-section, tapers in a direction from the annular body 712 toward the button pin 708.

Figure 7:
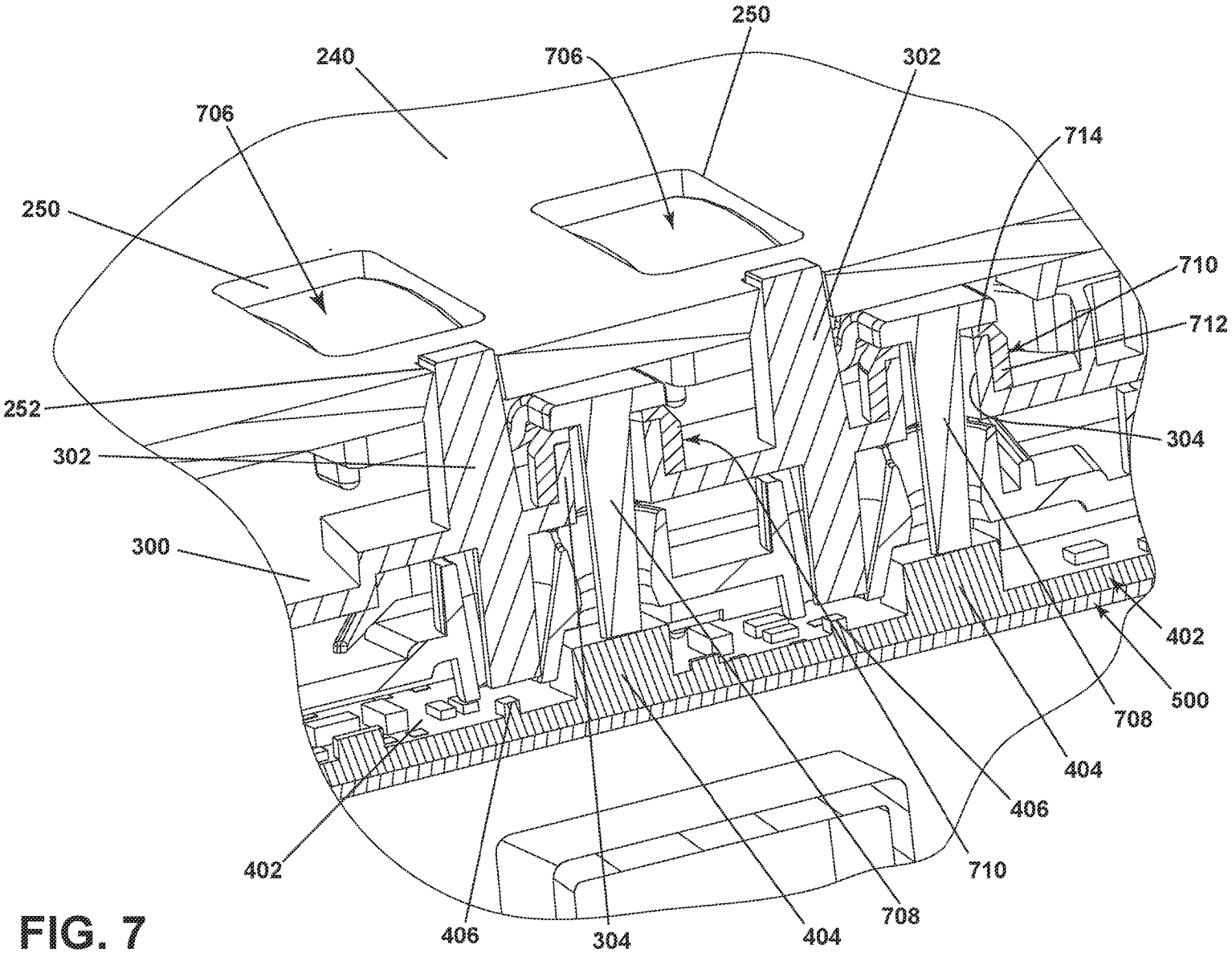
FIG. 7 is a detailed cross-section view of the push button assembly of FIG. 6 including a liquid seal and with the push button in a pressed state.

To assemble, the deflectable seal 710 is placed over the button guide collar 304 through an interference fit. The light guide assembly 300 is then assembled to the console 240 whereby the push button pin 708 enters an interference fit with the tapered deflectable flange 714 creating a liquid seal between the push button pin 708 and the light guide assembly 300. FIG. 6 illustrates the condition where the button 706 is in the off or extended state and the tapered deflectable flange 714 is not under pressure. Referring to FIG. 7, the same components of FIG. 6 are illustrated but with the button 706 in the on or depressed state with the tapered deflectable flange 714 in the compressed condition.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A laundry treating appliance comprising:

a cabinet defining a cabinet interior and a top wall with a cabinet access opening providing access to the cabinet interior; and a user interface carried by the cabinet and comprising:

a console having a first input opening;

a printed circuit board (PCB) located behind the console;

a rotary knob assembly comprising a knob, located above the console, and an input shaft extending from the knob through the first input opening and operably coupled to the PCB; and a liquid seal between the console and the knob, said liquid seal comprising a first collar extending rearwardly from the knob, a second collar extending away from the console and circumscribing the first input opening, and a rimmed bushing having an annular disk from which extends a first ring, which abuts with the first collar, and a second ring, which sits within the second collar, wherein the input shaft passes through the annular disk, and the annular disk abuts the second collar to form a first seal interface.

2. The laundry treating appliance of claim 1 wherein the second ring is adjacent the second collar to form a second seal.

3. The laundry treating appliance of claim 2 wherein the first seal and the second seal form a labyrinth seal.

4. The laundry treating appliance of claim 3 wherein the knob comprises a dome having a hollow interior overlying the console.

5. The laundry treating appliance of claim 4 wherein the knob further comprises a hub located within the hollow interior, with the input shaft coupled to the hub.

6. The laundry treating appliance of claim 5 wherein the console comprises a catch and the input shaft comprises a pin which is caught by the catch to retard removal of the knob from the console.

7. The laundry treating appliance of claim 6 wherein the dome terminates in an annular edge spaced above the console.

8. The laundry treating appliance of claim 1 wherein the user interface is located along a rear of the top wall.

9. The laundry treating appliance of claim 8 wherein the top wall is horizontal and the user interface is oriented at an acute angle to the top wall.

10. The laundry treating appliance of claim 9 further comprising a lid mounted to the cabinet and selectively closing the cabinet access opening.

11. The laundry treating appliance of claim 1 wherein the PCB comprises a depressible switch, and the user interface further comprises a second input opening, with a push button assembly having a button, located in the second input opening, and a button pin aligned with the depressible switch, a light guide having a guide collar circumscribing the button pin, and a deflectable seal provided between the button pin and the guide collar.

12. The laundry treating appliance of claim 11 wherein the deflectable seal comprises an annular body, which circumscribes the guide collar.

13. The laundry treating appliance of claim 12 wherein the deflectable seal further comprises a deflectable flange extending from the annular body and circumscribing the button pin.

14. The laundry treating appliance of claim 13 wherein the push button assembly further comprises an arm connecting the button and the button pin, wherein the button pin is offset from the button, and the deflectable flange is located between the arm and the guide collar.

* * * * *